US006353968B1

(12) United States Patent
Shyu et al.

(10) Patent No.: US 6,353,968 B1
(45) Date of Patent: Mar. 12, 2002

(54) SINGLE-BUTTON SUPPORT MECHANISM

(75) Inventors: Der-Rong Shyu, PuTzu; Kun-Yee Yang, PanChao; Chien-Hsing Tang; Wei-Feng Yen, both of Taipei, all of (TW)

(73) Assignee: Acer Peripherals, Inc. (TW)

( * ) Notice: Subject to any disclaimer, the term of this patent is extended or adjusted under 35 U.S.C. 154(b) by 0 days.

(21) Appl. No.: 09/643,861

(22) Filed: Aug. 23, 2000

(30) Foreign Application Priority Data

Sep. 14, 1999 (TW) ..... 88215699 U

(51) Int. Cl.[7] ..... E05D 11/10
(52) U.S. Cl. ..... 16/334; 16/377; 292/302
(58) Field of Search ..... 16/334, 324, 325, 16/326, 335, 377, 281, 370, 85, 86 R, 86 A; 403/92, 93, 94; 49/386, 394; 292/302, 300, 333–335; 312/319.1, 319.2; 360/680–682

(56) References Cited

U.S. PATENT DOCUMENTS 671,819 A * 4/1901 Davis ..... 16/344
702,304 A * 6/1902 Hulse et al. ..... 16/344
2,001,507 A * 5/1935 Stribling ..... 16/334
2,240,790 A * 5/1941 Kuney ..... 16/334
5,109,572 A * 5/1992 Park ..... 16/334
5,168,601 A * 12/1992 Liu ..... 16/329
5,265,969 A * 11/1993 Chuang ..... 403/93
5,734,548 A * 3/1998 Park ..... 361/680
5,754,395 A * 5/1998 Hsu et al. ..... 361/680
6,068,307 A * 5/2000 Murphy ..... 292/300

FOREIGN PATENT DOCUMENTS

FR 2662464 A1 * 11/1991

* cited by examiner

*Primary Examiner*—Chuck Y. Mah
(74) *Attorney, Agent, or Firm*—Troxell Law Office PLLC

(57) ABSTRACT

A single-button support mechanism is provided to improve a turning means joining an upper portion and a body of a device. The support mechanism constructs a pivot and a holding groove at the upper portion and, at the body, a cam trough, a button groove, and another groove for accommodating a retaining member to further hold a first spring. The cam is formed as saw type teeth at a peripheral thereof, and each tooth of the cam has a notch engageable with a position button. By applying the single-button support mechanism, the turning means can utilize the cam moving in the cam trough for engaging with the upper portion at a selected angle, and utilize the position button movable in the button groove for controlling the opening or closing of the upper portion.

18 Claims, 10 Drawing Sheets

SINGLE-BUTTON SUPPORT MECHANISM

BACKGROUND OF THE INVENTION (1) Field of the Invention

This invention relates to a single-button support mechanism for an electronic device that employs a single push button to control the opening of an upper portion from a main body at a desired angle.

(2) Description of the Prior Art

Electronic devices such as a scanner, a printer, a copier and the like are widely used nowadays. Each of those electronic devices usually includes an upper portion resting upon a main body for shielding internal delicate mechanisms away from any external contamination, in which the upper portion has to be openable for further repairs and maintenance of the internal mechanisms as required.

Conventionally, means for opening the upper portion of aforesaid electronic devices generally include two following types:

1. Push button and torsion spring means. The upper portion can be lifted by only utilizing a torsion spring after releasing a push button. In this type of mechanism, as the torsion spring becomes fatigue after a long time usage; the upper portion may not be lifted to a desired angle anyway.
2. Push button and hydraulic cylinder. The upper portion can be lifted after releasing a push button and then supported by a hydraulic cylinder. In this design, different weights of upper portions need to use different sizes of hydraulic cylinders. So, the design and production of the mechanism become more complicated and more expensive.

In addition to aforesaid mechanisms, there is also a two-step upper portion opening means being developed and used to lift the upper portion. However, the design is also complicated and the cost is hard to be reduced as well. Yet, there is stillroom for improvement upon a simpler and low-cost upper portion lifting means.

SUMMARY OF THE INVENTION

It is an object of this invention to provide a single-button support mechanism for opening and lifting the upper portion of an electronic device that includes a small number of parts and offers enhanced function even at a lower production cost.

The support means of the present invention utilizes a spring to take only charge of separating the upper portion from a device body of the electronic device, and leaves the supporting of the upper portion after being lifted to a rigid structure. Therefore, the spring of the present invention can be less prone to resilient fatigue like the conventional upper portion support means does. On the other hand, the rigid structure of the support mechanism in accordance with the present invention may be mass produced at lower cost, and may have a wider usage for supporting various sizes and weights of the upper portions without changing its structure.

The single-button support mechanism according to this invention includes a resilient means, a position button and a support means. The position button is located in the device body and further has a holding bar. The support means can be embodied as a cam located at the upper portion and further has a plurality of notches engageable with the holding bar. While pressing the position button, the resilient means located in the device body may make the upper portion separated from the device body. Then, the upper portion is free to be lifted rotationally upward and may be positioned notch by notch to a selected position by engaging the specific notch of the cam with the holding bar.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

This invention aims at providing a single-button support mechanism for an electronic device such as a printer, a copier, a fax machine, a scanner, a multifunctional peripheral (MFP) and the like. It is designed for opening and lifting the upper portion of the device to a selected angle easily and smoothly. Generally, the upper portion may provide protect function for the internal mechanism of the device, and may be disassembled from a device body as required for repairs and maintenance upon the internal mechanism.

Figure 1A:
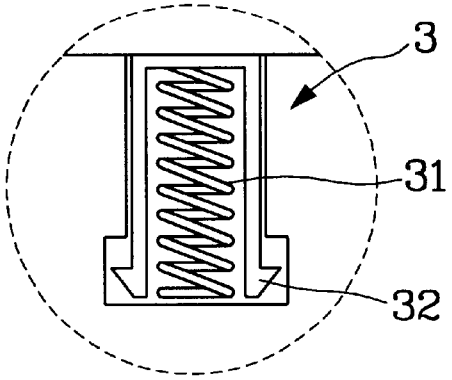
FIG. 1A is an enlarged view of the retaining member according to the present invention.
Figure 1:
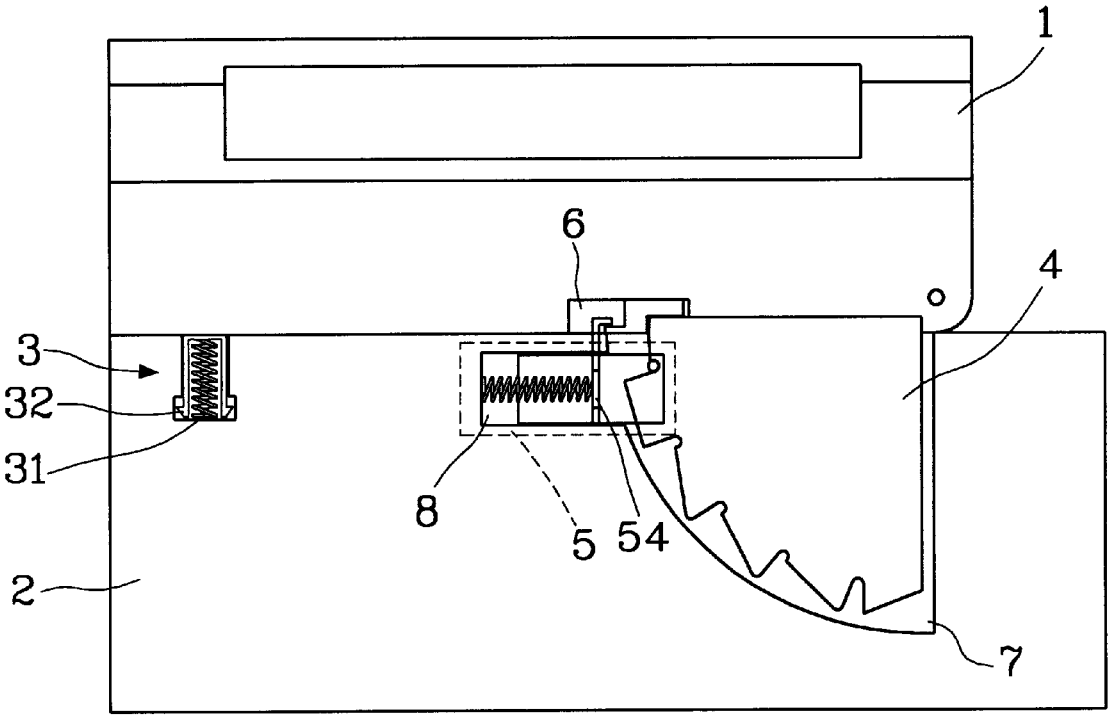
FIG. 1 is a side view of a first embodiment of the single-button support mechanism in accordance with the present invention, in which part of the device body is removed to shown the support mechanism thereinside.

Referring now to FIG. 1, a normal operation condition of the device is schematically shown with the upper portion 1 and the device body 2 engaged by a support mechanism. In the body 2, there is a vertical groove 3 at one end for holding a retaining member 32 thereinside. A first spring 31 is arranged inside the groove 3 and restrained between the retaining member 32 and the body 2. The upper portion 1 and the body 2 are pivotally engaged at another end of the device through a turning means, which includes a cam 4, fixed at the upper portion 1. The body 2 has a respective cam trough 7 to house the cam 4. The cam 4 as shown can pair with a position button 5 located at the body 2 to determine an opening position of the upper portion 1. As shown, the position button 5 is housed in a button trough 8 located in the body 2. The upper portion 1 also has a holding groove 6 for accommodating a respective portion of the position button 5 and a respective portion of the cam 4.

As shown in the enlarged portion of FIG. 1, the groove 3 for accommodating the retaining member 32 and the first spring 31 has an enlarged bottom structure cut further into the body 2 with right angle step walls. The retaining member 32 is formed as a reversed "U" shape member with two external hook type feet formed at the bottom ends engageable with the right angle step walls.

Figure 3A:
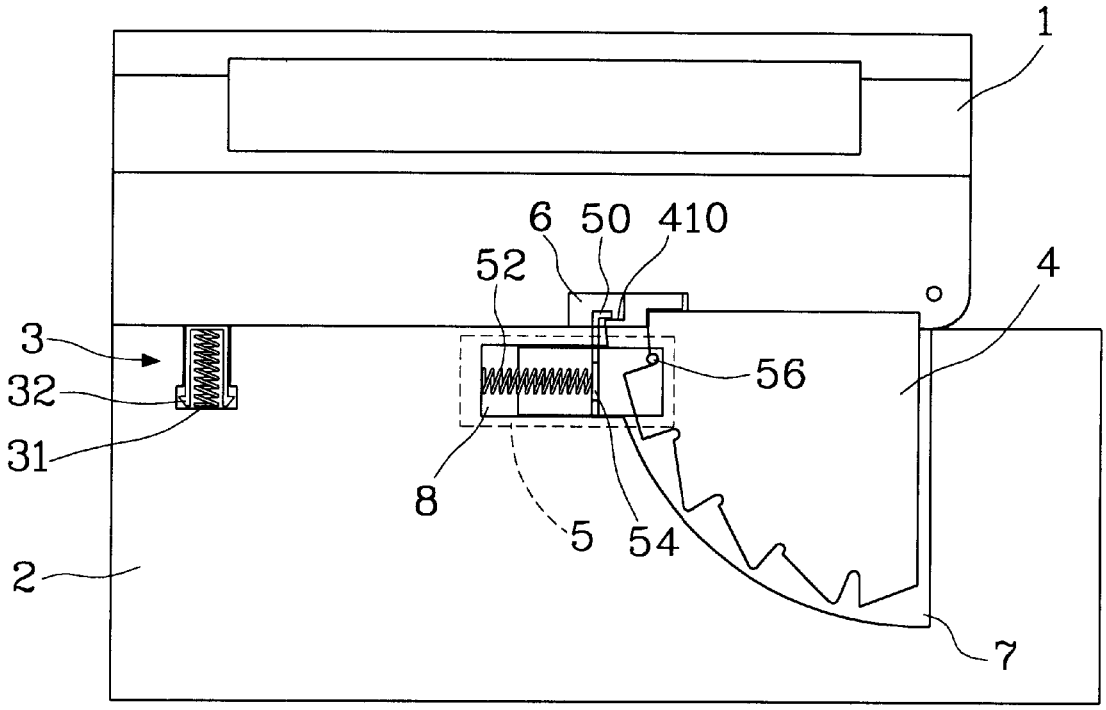
FIGS. 3A, 3B and 3C are side views of the first embodiment, showing different operating states.
Figure 3B:
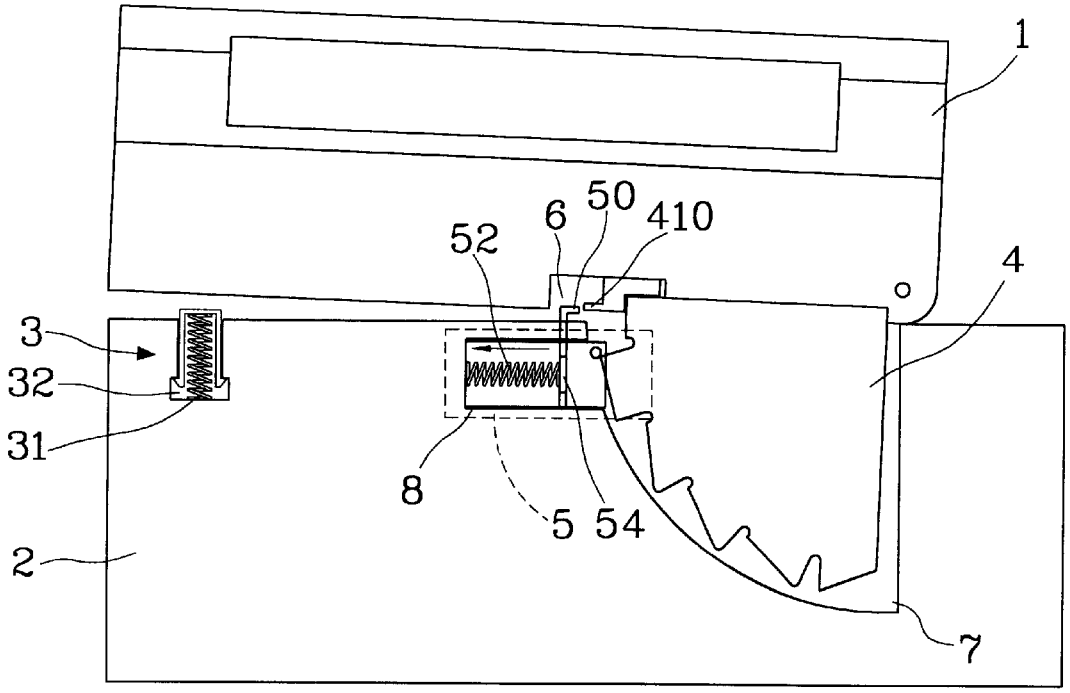

When the upper portion 1 is laid upon and fixed to the body 2 as shown in FIG. 3A, the position button 5 engages with the cam 4 at a respective limit position for holding together the body 2 and the upper portion 1, the retaining member 32 is pressed downward into the groove 3 and the first spring 31 is compressed. Referring to FIG. 3B, when the position button 5 is moved sideward (leftward in the figures) for the position button 5 to disengage with the cam 4, the fist spring 31 will push the retaining member 32 upward to lift the upper portion 1 open slightly at the respective end of the device by a selected distance. The retaining member 32 as shown is mostly held in the groove 3 due to the hook type feet engaging with the step walls of the groove 3. However, at this stage, the upper portion 1 is free to be rotationally lifted upward.

Figure 2:
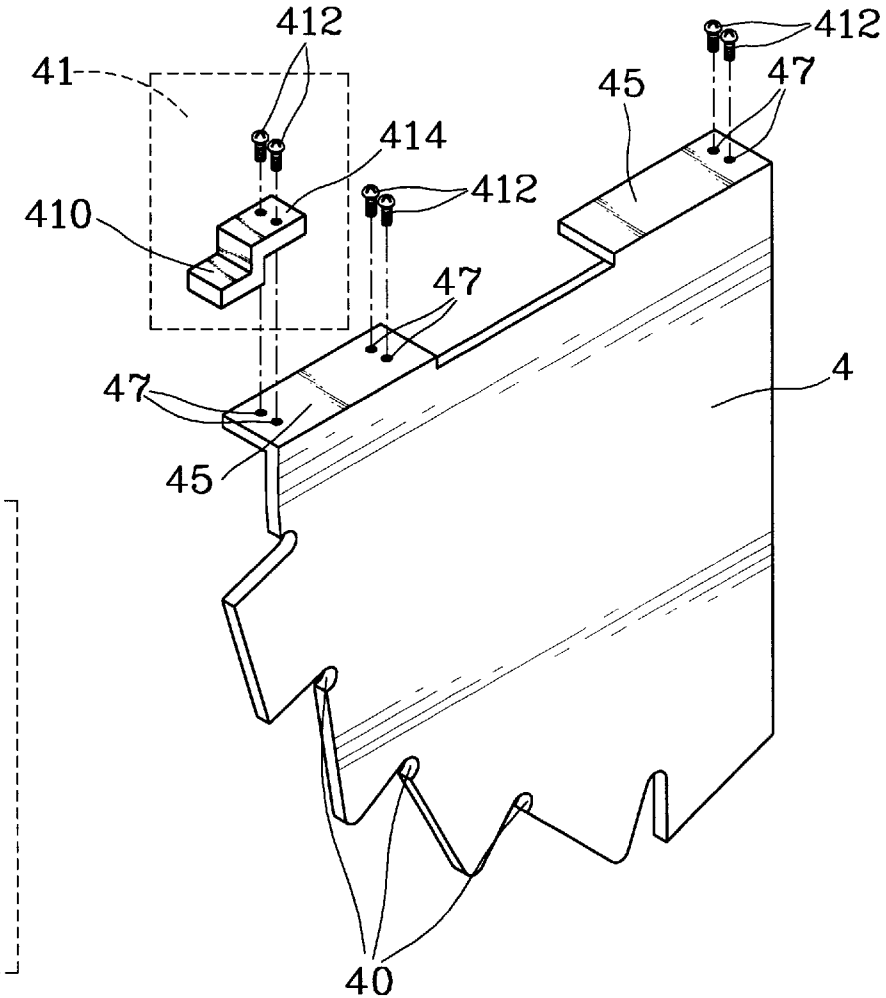
FIG. 2 is a fragmentary perspective view of the first embodiment shown in FIG. 1.
Figure 2A:
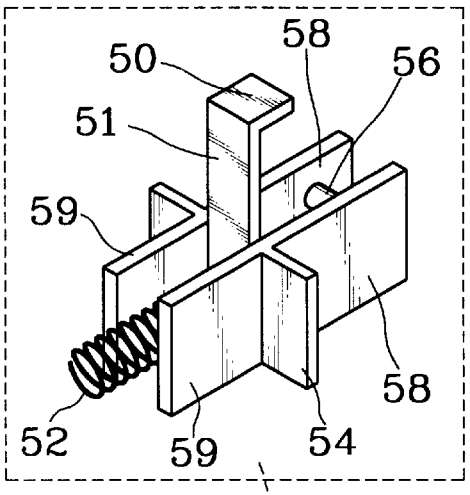
FIG. 2A is an enlarged perspective view of the position button of the present invention.

Referring now to FIG. 2, the turning means which includes the cam 4 and the position button 5 is shown in detail. The cam 4 of the present invention has a pair of top flanges 45 which have screw tapping 47 formed therein for being fastened with the upper portion 1 by means of screws 412. At a front edge of one flange 45, a step member 41 is disposed thereon for pairing with a wedge tongue 50 of the position button 5, in which the step member 41 includes an upper step member 414 and a lower step member 410 protruding beyond the flange 45. While the upper portion 1 rests upon the body 2, the step member 41 of the cam 4 and the wedge tongue 50 of the position button 5 forms as a restriction structure to confirm the combination of the upper portion 1 and the body 2.

As shown, the cam 4 has a plurality of saw-type teeth formed at a peripheral edge thereof. Each tooth has a notch 40 formed at the tooth root for occasionally engaging with a holding bar 56 of the position button 5. By providing the holding bar 56 and the notch 40 of the cam 4, the upper portion 1 can then be pulled to a desired angle from the body 2.

The position button 5, located in the body 2, has a horizontal wedge tongue 50 engageable with the lower step member 410 and a vertical wedge wall 51 sandwiched by a pair of front side walls 58 and rear side walls 59. The position button 5 also includes a lug 54 extending out of the body 2. Between the front side walls 58, a round holding bar 56 is provided for engaging with the notch 40 of the cam 4. Between the rear side walls 59 and behind the wedge wall 51, a second spring 52 is provided. The second spring 52 has its one end contacting with the wedge wall 51 and another end contacting with the body 2. The position button 5 is mostly housed in the button trough 8 formed in the body 2. The holding groove 6 formed respective in the upper portion 1 also provide a substantial room to accommodate part of the step member 41 and the position button 5.

Figure 3C:
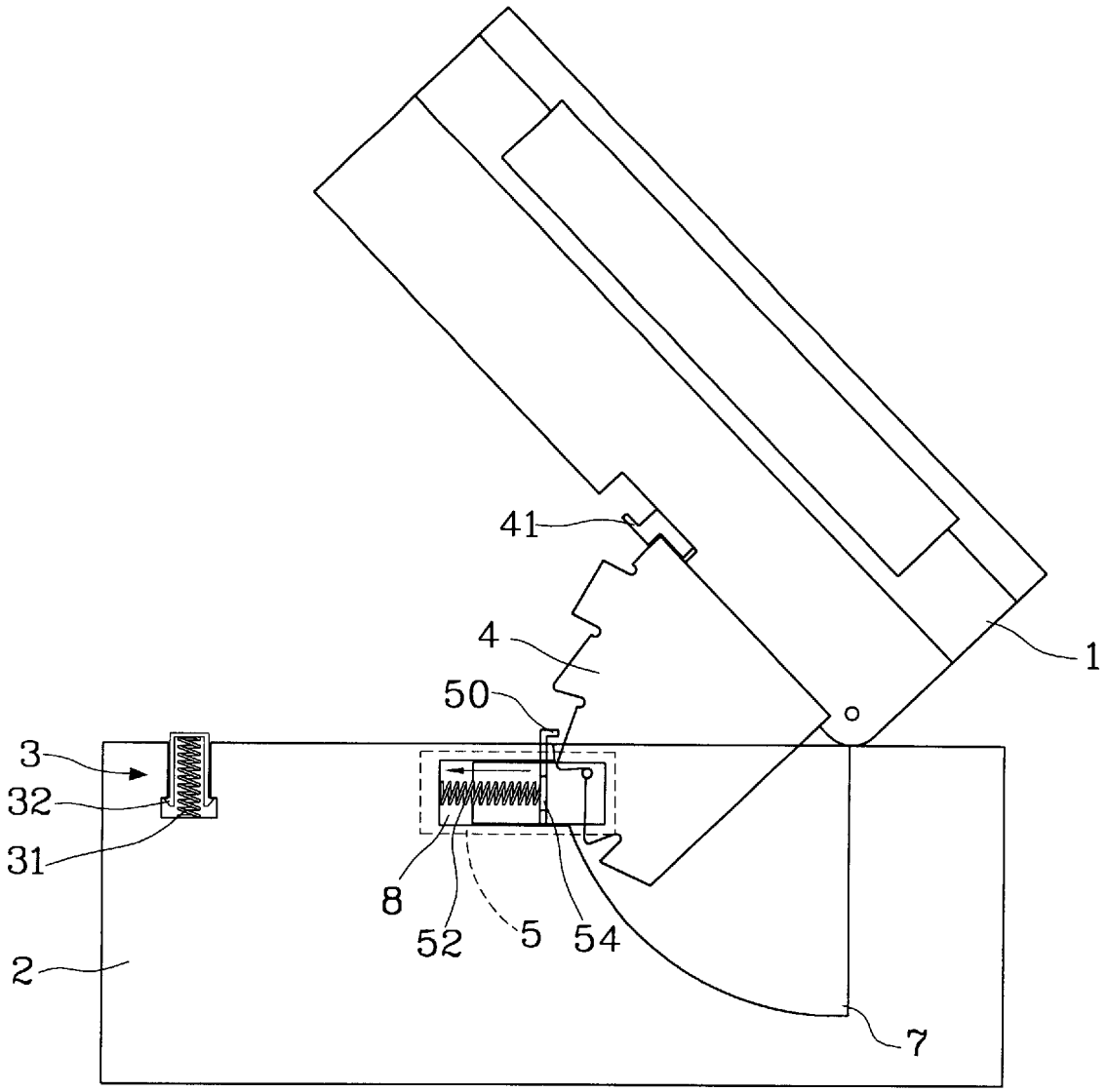
Figure 4A:
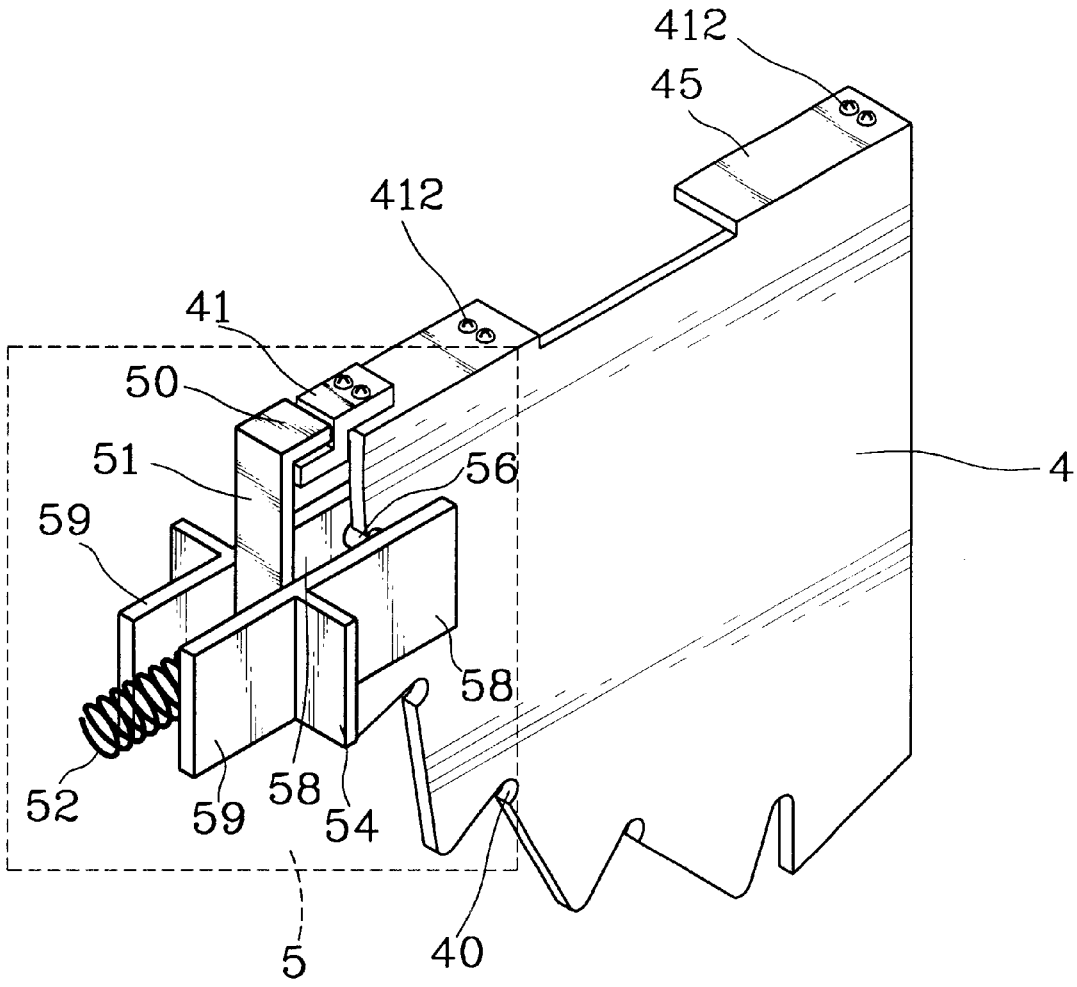
FIGS. 4A, 4B and 4C are perspective views of a turning means for FIGS. 3A, 3B and 3C.
Figure 4B:
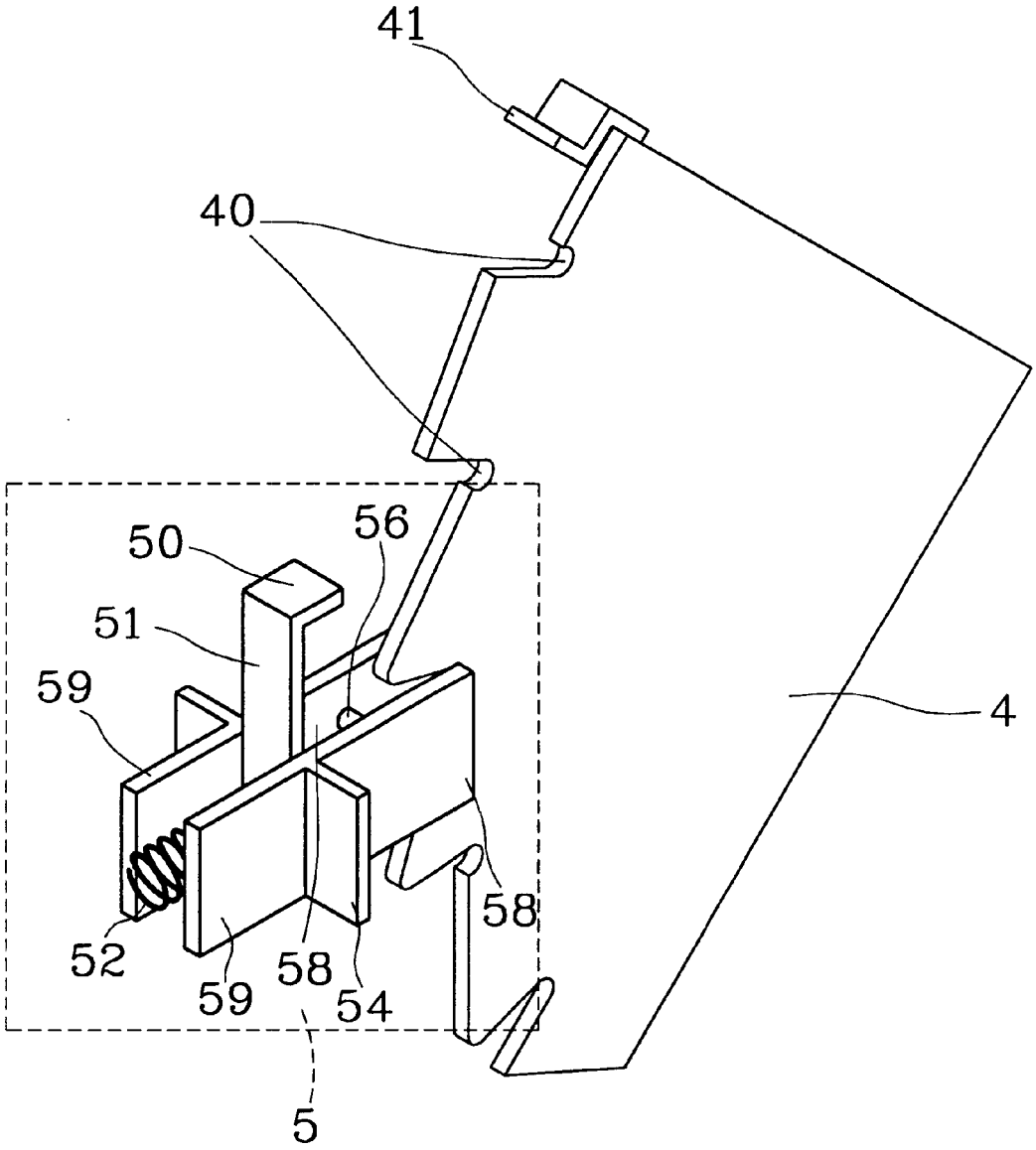
Figure 4C:
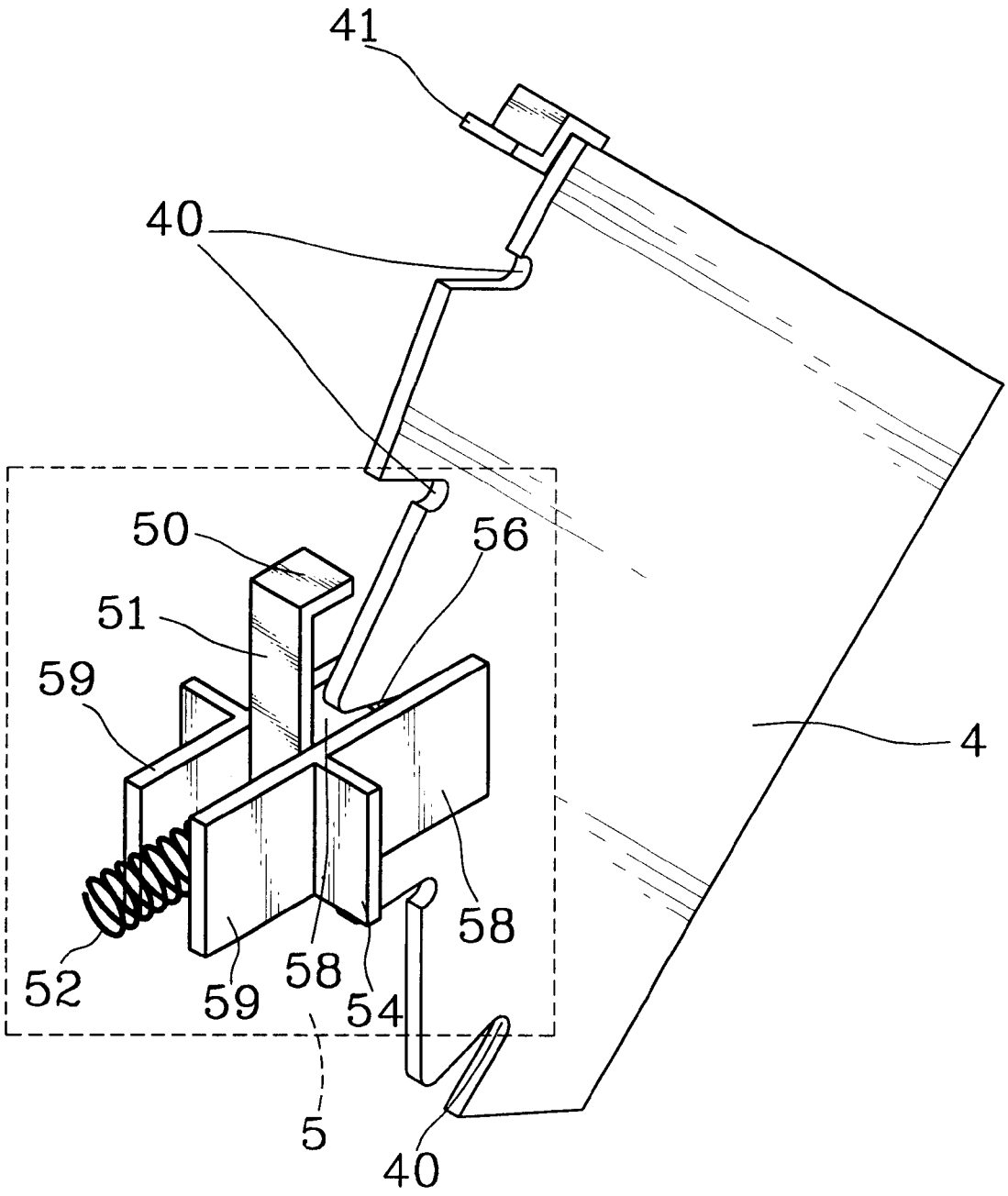

Referring now to FIG. 3A to FIG. 3C, a series of operation states upon lifting the upper portion 1 from the body 2 are shown orderly, Also, respective engaging between the position button 5 and the cam 4 can be observed from FIG. 4A to FIG. 4C.

FIG. 3A shows a normal operation state with the upper portion 1 resting closely on top of the body 2. When the upper portion 1 engaged with the body 2 for the normal operation, the wedge tongue 50 engages with the lower step member 410 as shown in FIG. 4A. While the upper portion 1 is latched and laid upon the body 2, the retaining member 32 is pressed downward and the first spring 31 is compressed. Also, the holding bar 56 of the position button 5 engages with the limited one of the notches 40 of the cam 4.

FIG. 3B shows the operation state that the upper portion 1 is just released from the body 2. At this stage, referring now to FIGS. 3B and 4B, the lug 54 is pushed against the second spring 52 to disengage the wedge tongue 50 of the position button 5 with the lower step member 410 of the cam 4. The holding bar 56 of the position button 5 then moves away from the notch 40 of the cam 4 to release the engagement of the upper portion 1 and the body 2. The first spring 31 then can release the built-in compression energy and push the retaining member 32 upward, which consequently pushes pivotally the upper portion 1 upward slightly. The upper portion 1 thus is unlatched and at a state ready for lifting.

Referring to FIGS. 3C and 4C, the disengaged upper portion 1 is now free to be lifted pivotally from the end of the body 2 locating the groove 3. While lifting the upper portion 1, the teeth of the cam 4 can slide over the holding bar 56 without any application upon the position button 5, due to the wedge form of the teeth. When a desirable lifting angle is reached, the lifting will be removed to have the weight of the upper portion 1 to drop the upper portion 1 a little bit for the second spring 52 pushing the holding bar 56 forward to engage with the respective notch 40 of the cam 4. The upper portion 1 thus may maintain the opened and lifted position as desired. In the present invention, the number and pitch of the teeth of the cam 4 may be set arbitrarily or may be decided according to the lifting angles as desired.

While closing the upper portion 1 over the body 2 for another run of normal operation again, the lug 54 is needed to be pushed against the second spring 52 for disengaging the holding bar 56 of the position button 5 from the respective notch 40 of the cam 4, and then the upper portion 1 may be placed pivotally down onto the body 2 until the position state shown in FIG. 3A or 4A is achieved.

Figure 5:
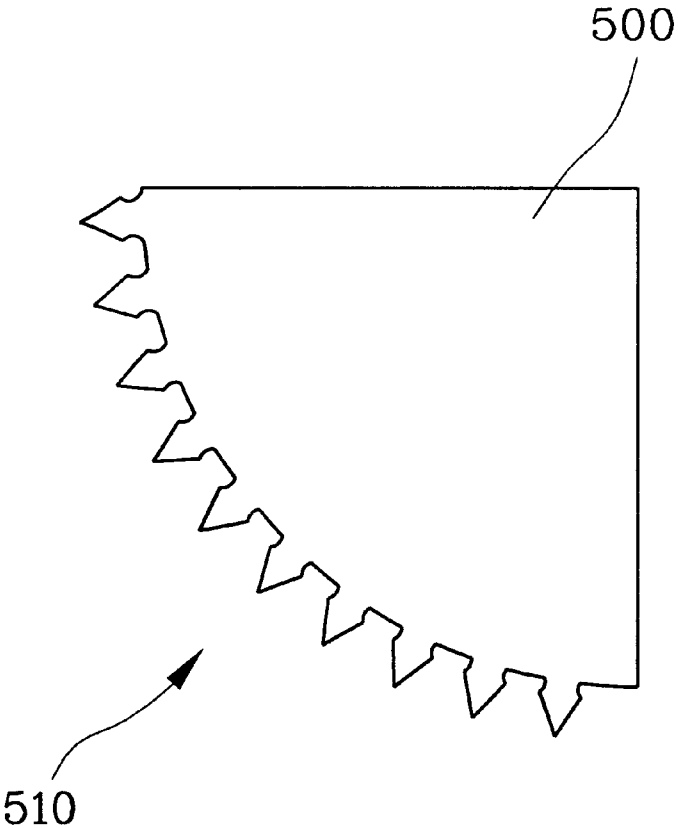
FIG. 5 is a side view of a second embodiment of the cam of this invention.

FIG. 5 shows a second embodiment of the cam 4 for the present invention. Instead of the saw-type cam peripheral shown in the first embodiment of FIG. 1, the second embodiment of the cam can utilize a section of a ratchet wheel 500. As shown, the ratchet teeth 510 structure of the second embodiment enables the upper portion I to be opened and lifted at various angles as desired.

Figure 6:
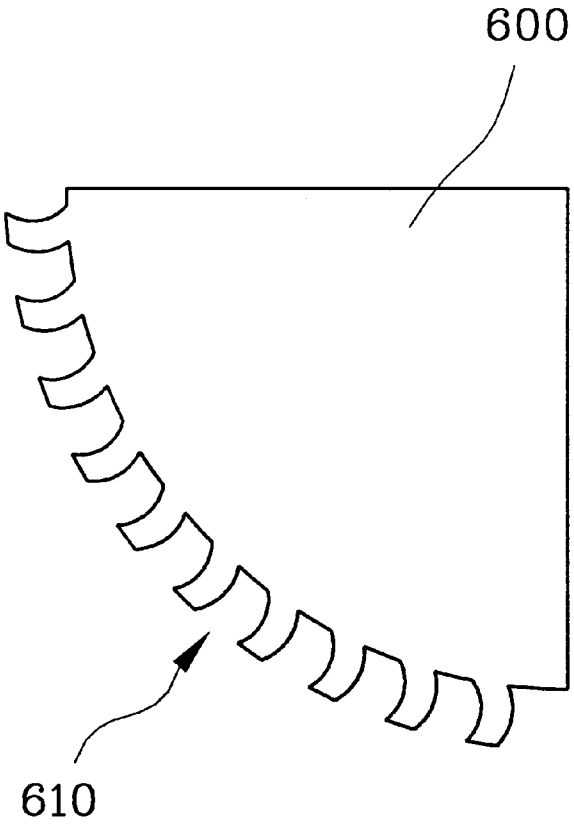
FIG. 6 is a side view of a third embodiment of the cam of this invention.

FIG. 6 shows a third embodiment of the cam 4 in accordance with the present invention. In the embodiment, the cam utilizes a section of gear 600, which includes asymmetrical teeth 610 for directionally supporting the upper portion 1 at various angles as desired.

Figure 7:
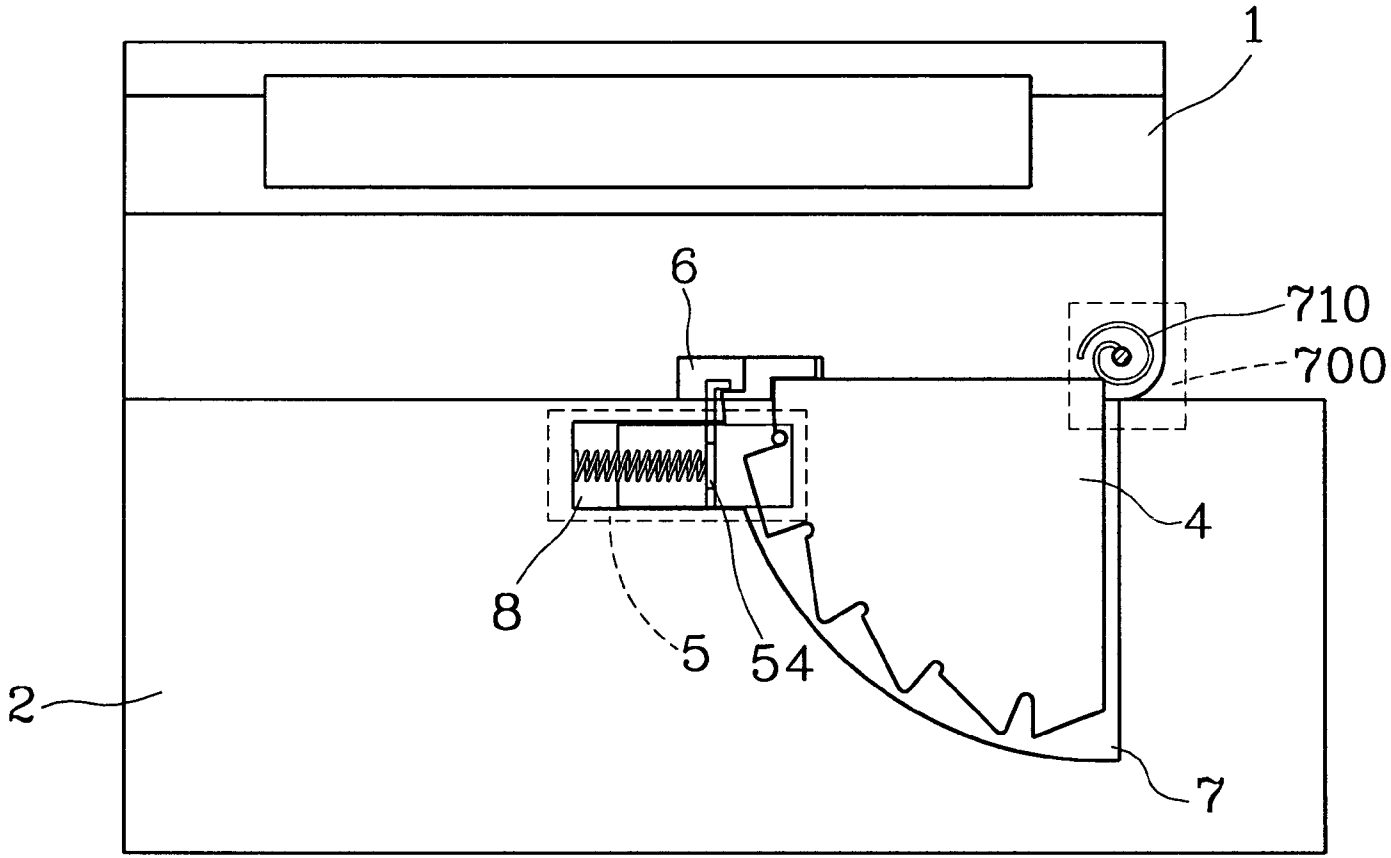
FIG. 7 is a side view of a fourth embodiment of the single-button support mechanism in accordance with the present invention.

Referring now to FIG. 7, a fourth embodiment of this invention is shown. Instead of using a first spring to push the upper portion 1 at the initial lifting stage in the first embodiments described above, a torsion spring 710, disposed around the shaft 700 of the turning means pivoting the upper portion 1 and the body 2, is introduced in this embodiment for providing an uplifting forcing to separate pivotally the upper portion 1 from the body 2 while the position button 5 and the cam 4 are disengaged.

By means of the structure set forth above, the initial opening of the upper portion 1 may be achieved by means of the first spring 31 or the torsion spring 710. The holding and supporting of the lifted upper portion 1 can be done through the engagement of the notch of the cam 4 with the holding bar 56 of the position button 5. In the present invention, the cam 4 and the position button 5 can be made of rigid and strong materials for supporting various sizes and weights of upper portions 1. In this present invention, the resilient fatigue of the spring thus may be minimized. The lifting angle of the upper portion 1 may have a wider range of selection depends on the teeth number and pitch of the cam.

In the following description, another wording or realization of the present invention can also be utilized.

The position button 5 can have a first position and a second position. While the position button 5 is posed at the first position, the holding bar 56 can engage with one of the notches 40 and the upper portion 1 and the body 2 can form a selected angle therebetween, as shown in FIG. 3C or in FIG. 3A. While the position button 5 is posed at the second position as shown in FIG. 3B, the holding bar 56 may disengage with the notch 40 and the upper portion 1 can be lifted pivotally with respect to the body 2.

Also, the groove 3, the retaining member 32 and the first spring 31 can form an ejection means for moving the upper portion 1 away from the body 2 for a selected distance when the position button 5 is at the second position.

It may thus be seen that the objects of the present invention set forth herein, as well as those made apparent from the foregoing description, are efficiently attained. While the preferred embodiments of the invention have been set forth for purpose of disclosure, modifications of the disclosed embodiment of the invention as well as other embodiment thereof may occur to those skilled in the art. Accordingly, the appended claims are intended to upper portion all embodiments, which do not depart from the spirits and scope of the invention.

What is claimed is:

1. A single-button support mechanism for improving a turning means joining an upper portion and a body, the body having a pivot end and a free end, comprising:

a holding groove located in the upper portion;

a cam trough and a button groove, located in the body and close to the pivot end;

a retaining groove, located in a top surface of the body, the retaining groove having a closed bottom end;

a retaining member slidably received within the retaining groove with a top end of the retaining member contacting with the upper portion;

a first spring disposed within the retaining groove, the first spring restrained by the retaining member and the closed bottom end;

a position button slidably received within the button groove and movable between a first position and a second position; and a cam rotatably received within the cam trough pivotally connecting the body and the upper portion, the cam having saw-type teeth formed at a periphery thereof, each of the teeth being selectively engageable with the position button, wherein the position button engaged the locking groove when the position button is in the first position, and the position button disengaged with the teeth and the locking groove when the position button is in the second position enabling the retaining member to push the upper portion upward.

2. The single-bufton support mechanism of claim 1, wherein the retaining groove in the body has a narrow upper portion and an enlarged lower portion.

3. The single-button support mechanism of claim 1, wherein the retaining member is an inverted "U"-shape member having two feet hooks at a bottom thereof engaged with the groove.

4. The single-button support mechanism of claim 1, wherein the cam includes a step member engageable with the position button for latching the upper portion to the body.

5. The single-button support mechanism of claim 4, wherein each of the teeth has a curved shape engaging with the position button to fix the upper portion at a desired location.

6. The single-button support mechanism of claim 5, wherein the cam has a flange fastened with the upper portion by screws engaging screw bores formed in the flange.

7. The single-button support mechanism of claim 4, wherein the step member comprises a lower step member and an upper step member, which has screw bores formed therein and is fastened with the cam by means of screws.

8. A single-button support mechanism for improving a turning means joining an upper portion and a body, comprising:

a cam, movably located in the body and having a plurality of notches formed thereon; and a position button, located in the body and movable between a first position and a second position and including a holding bar;

an ejection means for moving the upper portion away from the body for a selected distance when the position button is at the second position;

wherein the upper portion and the body form a selected angle therebetween when the position button is at the first position and the holding bar engaged with one of the notches; and wherein the holding bar disengages with the notch when the position button is at the second position.

9. The single-button support mechanism of claim 8, wherein the holding bar is round and is engageable with one of the plurality of notches of the cam.

10. The single-button support mechanism of claim 8, wherein the ejection means is located in the body and includes a groove, a retaining member and a first spring.

11. The single-button support mechanism of claim 10, wherein the groove has a narrow upper portion and an enlarged lower portion forming a right angle side wall, the retaining member is an inverted "U" shape member, having a foot hook at a bottom engaged with a right angle side wall for preventing the retaining member from disengaging from the groove under the pushing force of the first spring.

12. The single-button support mechanism of claim 10, wherein the ejection means is a torsion spring located at a juncture of the upper portion and the body.

13. The single-button support mechanism of claim 8, wherein the notches are gear valleys.

14. The single-button support mechanism of claim 8, wherein the notches are formed as a section of a ratchet.

15. The single-button support mechanism of claim 8, wherein the notches are formed as a section of an asymmetrical gear.

16. The single-button support mechanism of claim 8, wherein the position button has a wedge tongue engageable with a step member fastened to the cam when the position button is located at the first position.

17. The single-button support mechanism of claim 8, wherein the position button is movable between the first and the second positions by means of a second spring.

18. A pivotal connecting mechanism for connecting an upper portion onto a body, the pivotal connecting mechanism comprising:

a locking groove formed on the upper portion;

a retaining groove, a cam trough, and a button groove formed on a top surface of the body, the retaining groove having a closed bottom end;

a retaining member slidably received within the retaining groove, a top end of the retaining member contacting with the upper portion;

a spring disposed within the retaining groove, the spring restrained between the retaining member and the closed bottom end;

a position button slidably received within the button groove and slidable between a first position and a second position; and a cam rotatably received within the cam trough pivotally connecting the body and the upper portion, the cam having a plurality of teeth formed at a periphery;

wherein the position button is engaged with the locking groove when the position button is in the first position, and the position button disengaged with the teeth and the locking groove when the position button is in the second position enabling the retaining member to push the upper portion upward.

* * * * *